US005316066A

United States Patent [19]

Rapp et al.

[11] Patent Number: 5,316,066

[45] Date of Patent: May 31, 1994

[54] CORD-LOCK MECHANISM

[75] Inventors: William H. Rapp, Buena Park, Calif.; Ira Gaber, West Norwalk, Conn.; Cooper C. Woodring, Topeka, Kans.

[73] Assignee: Nien Made Enterprise Co., Ltd., Chang Hua, Taiwan

[21] Appl. No.: 985,959

[22] Filed: Dec. 4, 1992

[51] Int. Cl.[5] ..... E06B 9/324

[52] U.S. Cl. ..... 160/178.2; 24/461

[58] Field of Search ..... 160/178.2, 168.1, 173, 160/176.1; 24/461, 462, 115 H, 127, 129 A, 136 L

[56] References Cited

U.S. PATENT DOCUMENTS

| | | | |
|---|---|---|---|
| 2,544,184 | 3/1951 | Rosenbaum | 160/177 |
| 2,555,709 | 6/1951 | Sherwood | 160/168.1 |
| 2,620,866 | 12/1952 | Rosenbaum | 160/177 |
| 3,552,473 | 5/1969 | Persson | 160/176.1 X |
| 3,605,852 | 9/1971 | Vecchiarelli | 160/168.1 |
| 4,463,791 | 8/1984 | McClure | 160/178.2 |

*Primary Examiner*—David M. Purol

*Attorney, Agent, or Firm*—Bacon & Thomas

[57] ABSTRACT

A cord-lock mechanism to take up or expand slats of Venetian blind, comprising a fixed hollow drum with an end cover secured to window frame or door frame; a pulley block fixed in the hollow drum, a pulley at the pulley block, a brake wheel reciprocally movable between a braking position and a release position in a guide channel formed on the pulley block; and a lift cord made of soft material, wound around the brake wheel and the pulley, having its both ends extended to the respective ends of the headrail, passed through the middle cord outlets, turned downwards and tied to the respective ends of the foot rail so that all or part of the slats and the tubular foot rail can be raised and the slats can be taken up by pulling of the lift cord.

4 Claims, 6 Drawing Sheets

CORD-LOCK MECHANISM

BACKGROUND OF THE INVENTION (1) Field of the Invention

The present invention relates to a lifter for Venetian blind, particularly a cord-lock mechanism to support the slats, and, take up or release a lift cord to raise or lower the slats.

(2) Description of the Prior Art

Each Venetian blind is composed of a plurality of vertical or horizontal slats running in parallel, the tilting of which can adjust indoor darkness and preserve confidence in personal living. It is being extensively used in offices and homes. The conventional horizontal Venetian blind being used can have its slats tilted and lifted, and comprises mainly a rectangular sectioned and non-rotary headrail, a foot rail, two or more ladders each including an outer ladder and an inner ladder suspending from the headrail to the foot rail to support a plurality of slats with a plurality of connecting tapes located between the outer and inner ladders, a tilter within the headrail and a transmission device therefor to tilt the slats, and a lifter to raise and lower the slats. The lifter is incorporated with a lift cord, at least two wires extending from the headrail to the foot rail and connected to the lift cord, and a pulley set. When the lift cord is pulled upwards, the pulley set causes the wires tied to the foot rail to displace upward simultaneously to raise the foot rail as well as all or part of the slats, and consequently cause the lower slats to close to the upper slats.

The conventional lifter for a Venetian blind is quite complicated in structure. Hence, its production cost is high. Moreover, it is hardly to implement mass production with automatic assembly process, and it indeed has the following defects:

(1) Such sophisticated lifter required assembly at factory, and its installation position can not be changed after it is assembled to satisfy the user's habit or environmental requirements. Production and use of which are hence inconvenient.

(2) In general the conventional lifter can not rotate the headrail directly, and to tilt the slats, the conventional tilter must includes worm drive, transmission shaft, bearings and gears to drive some ladder drums to rotate, and hence the structure of the conventional Venetian blind is very complicated and heavy, production cost of which is thus relatively high.

(3) In association with the conventional tilter, the conventional lifter requires a lot of sophisticated components and long transmission, and therefore in the cause of raising or lowering, the slats and the foot rail may become higher at one end and lower at the other end due to unbalanced force applied to the lift cord and extra long transmission, and in the most serious case the slats and the foot rail may be seized and can't be raised or lowered.

SUMMARY OF THE INVENTION

The present invention provides a simple and easy-to-operate cord-lock mechanism for a Venetian blind with minimum failure possibility. It can rotate headrail of the blind directly, and effectively simplify the components required in both the tilter and lifter of the Venetian blind. The tilter mechanism according to the present invention comprises a hollow drum secured to window frame or door frame, an end cover, a pulley block fixed within the drum, a pulley installed at the pulley block, a brake wheel linearly movable within a guide channel at the pulley block, and a lift cord made of soft material. Both ends of the lift cord are led to pass through the brake wheel and the pulley, and then passed through two outlet at the two drums located at two ends of the headrail, extended downward and tied to two cord holders at two ends of the tubular foot rail. The cord holders are identical to the ladder holders. The cord holders and the ladder holders are interchangeable. By pulling of the lift cord, the slats can be raised and lowered fully or partly to any desired level.

Therefore, the main object of the present invention is to provide a cord-lock mechanism for Venetian blind with minimum components and simple structure without any transmission shaft. It is a design that permits mass production with automatic assembly process at low production cost.

Another object of the present invention is to provide a cord-lock mechanism which can be installed at either end of the headrail to satisfy different user's habit and different indoor installation requirements.

Another object of the present invention is to provide cord-lock mechanism for Venetian blind which permits efficient and prompt retraction and extension of slats, assures easy operation, long service life and minimum failure possibility in comparison with the conventional tilter.

Another object of the present invention is to provide a cord-lock mechanism for Venetian blind to be supplied to the general consumers in the form of a "DIY" kit to permit assembly and replacement of slats by the consumers.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
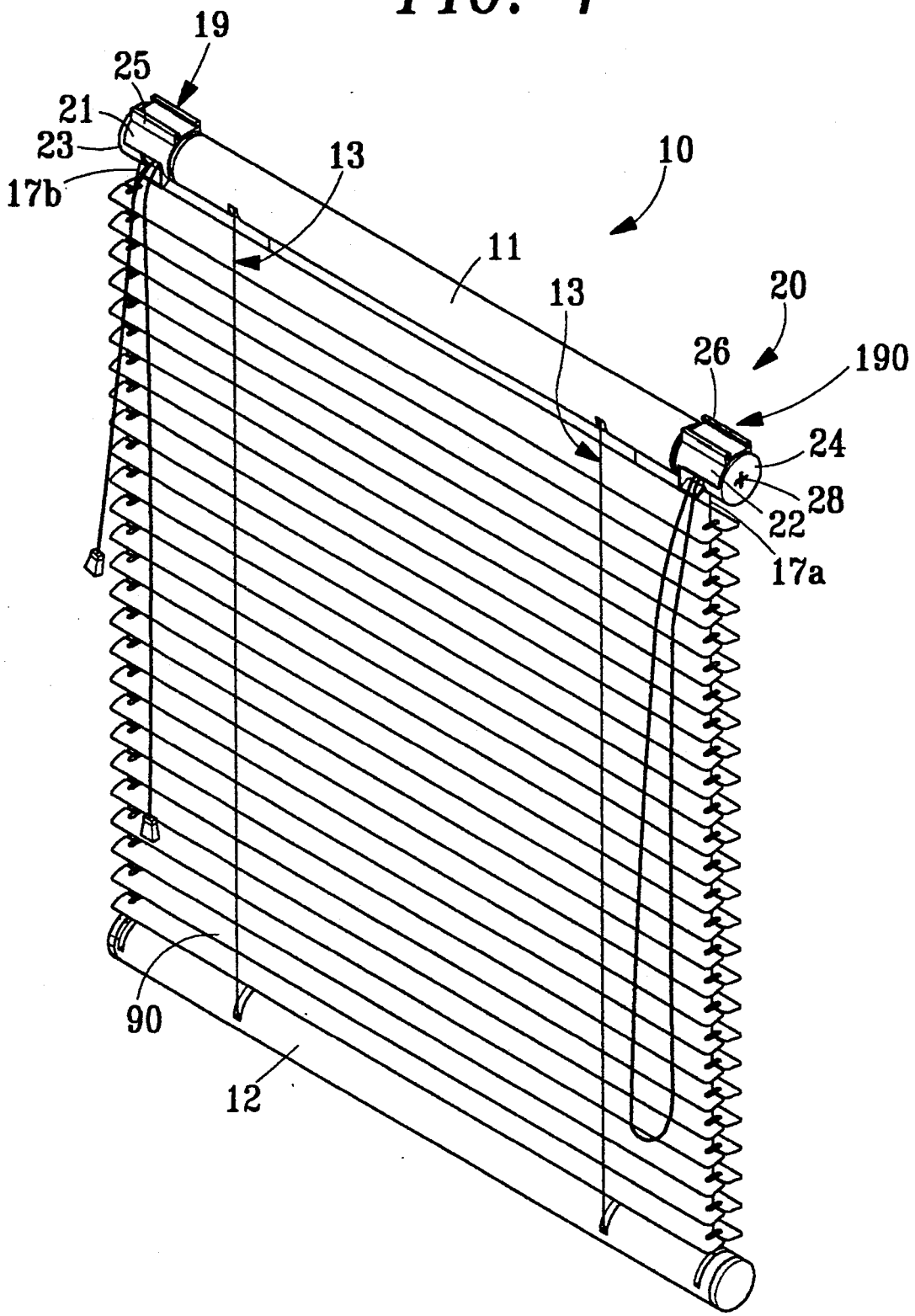
FIG. 1 is a perspective view of a horizontal Venetian blind with a cord-lock mechanism according to the present invention.
Figure 2:
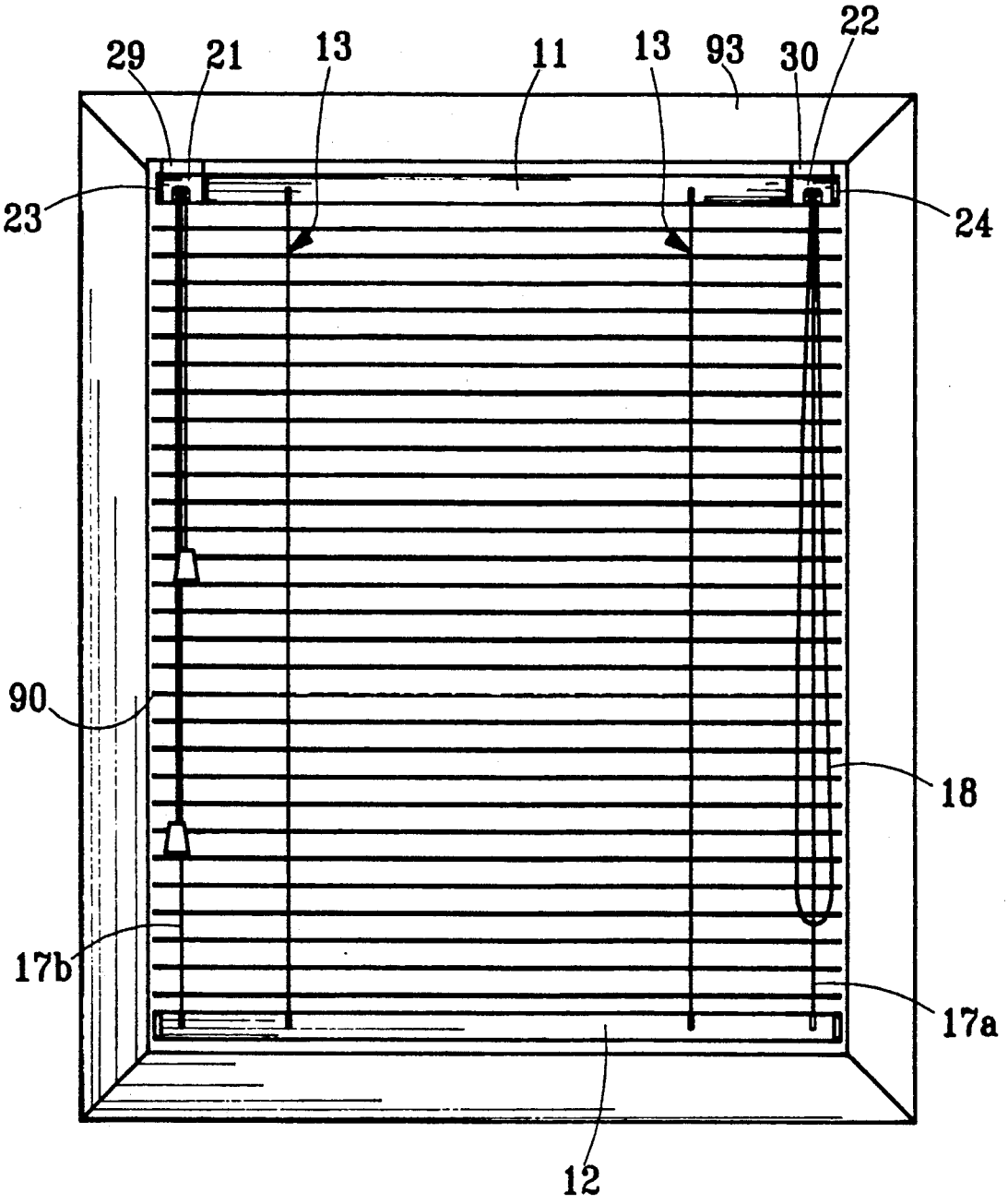
FIG. 2 is a front view of the Venetian blind as installed in a window frame.
Figure 3:
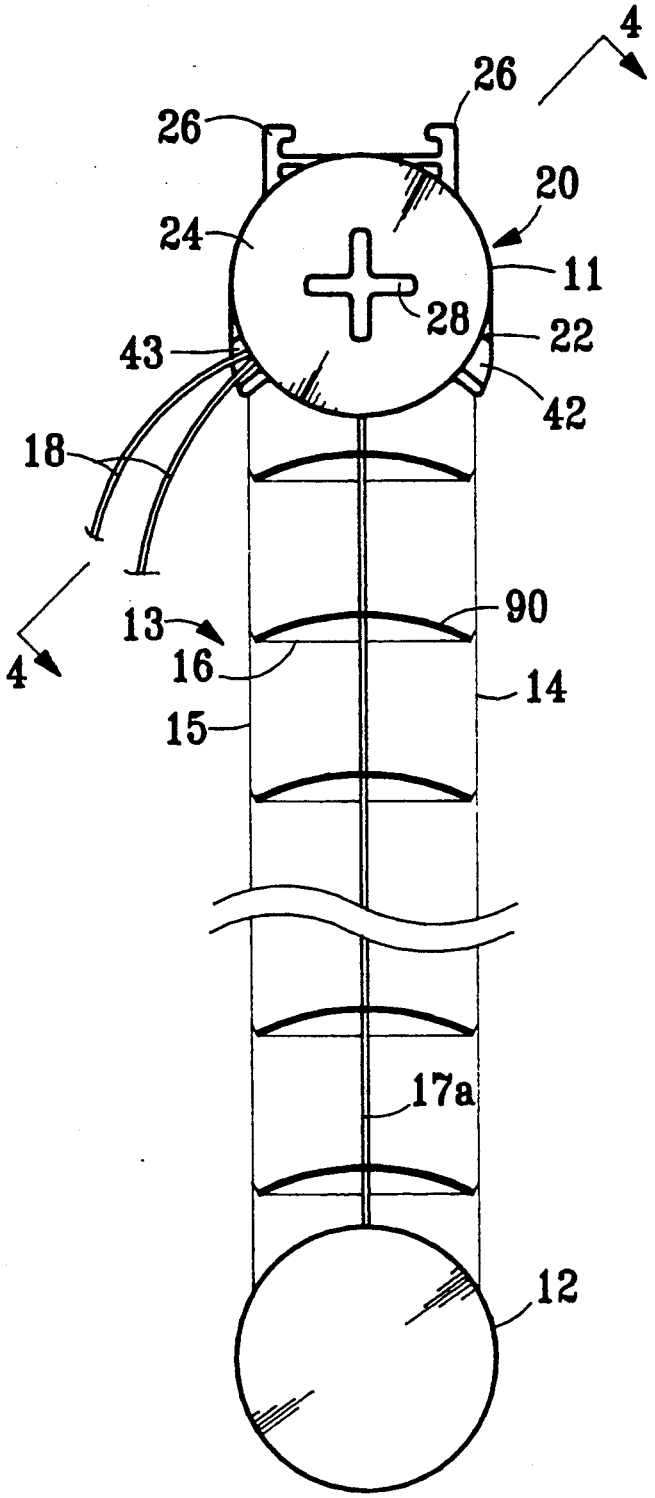
FIG. 3 is a magnified side view of the Venetian blind.

Please refer to FIGS. 1 through 4, the Venetian blind (10) incorporated with the cord-lock mechanism (20) according to the present invention comprises mainly a rotary tubular headrail (11), a rotary tubular foot rail (12), two ladder sets (13) extending from the headrail (11) to the foot rail (12) to support a plurality of parallel horizontal slats (90), a tilter (19) located at any end of the headrail (11), and a lifter (20) located at another end of the headrail (11). Each ladder set (13) is composed of an outer ladder tape (14), an inner ladder tape (15), and a plurality of horizontal connecting tapes (16) each beneath a slat (90) to support a slat (90). The ladder sets (13) are secured between an end of the headrail (11) and an end of the foot rail (12) at the same side directly, or retained between the headrail (11) and the foot rail (12) with a ladder holder (not shown) indirectly. When the headrail (11) is rotated, the ladder tapes (14 and 15) at two opposite sides of the headrail is cause to perform vertical movement linearly in two opposite directions so that the slats supported by the horizontal connecting tape (16) are tilted for a same degree accordingly. The positions of the tilter (19) and the lifter (190) are interchangeable. Each of them can be fixed to either end of the headrail (11).

Figure 4:
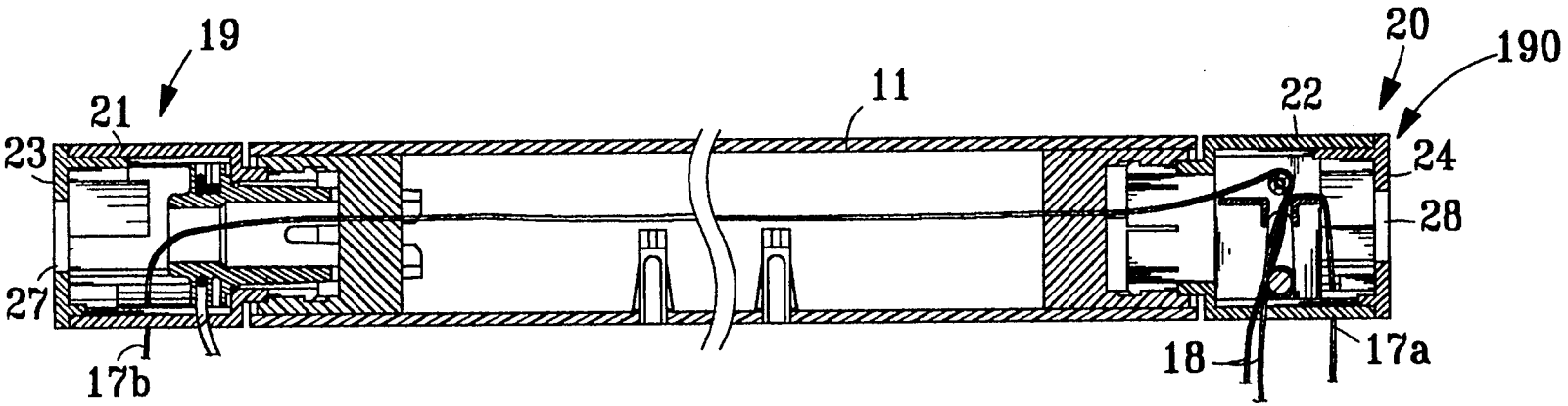
FIG. 4 is a cross-sectional view taken along line 4—4 in FIG. 3.

The cord-lock mechanism (20) according to the present invention can be installed at either end of the headrail (11), and permits free rotation of the headrail (11). Therefore, the Venetian blind (10) incorporated with the cord-lock mechanism (20) according to the present invention can have its headrail rotated directly by the tilter mechanism (19) shown in FIG. 4. Rotation of the headrail (11) can cause the inner ladder tape (14) and the outer ladder tape (15) to perform vertical movement linearly in two opposite directions, and consequently the slats (90) are tilted accordingly without any worm drive, long transmission, gear and other sophisticated mechanism. Hence, the overall structure of the blind (10) is effectively simplified. The tilter (19) includes a hollow drum (21) with an end cover (23), and is fixed to a window frame (93). The lifter (190) also includes a hollow drum (22) with an end cover (24) of exactly the same shape fixed to the window frame (93). Each of the drums (21 and 22) has a pair of upward extended ribs (25 and 26), and each of the end covers (23 and 24) has a cross slot (27 or 28). Each of the drums (21 and 22) can be easily secured to a side of the window frame (93) with the extended ribs (25 and 26) or the cross slot (27 or 28) in association with two conventional fasteners (29 and 30). Hence, the tubular headrail (11), which is designed with a size corresponding to the width of the window frame (93), is freely rotatably suspended between the drums (21 and 22). As shown in FIG. 4, the cord-lock mechanism (20) according to the present invention includes two pull cords (17*a* and 17*b*) extending from the headrail (11) to the foot rail (12) and substantially connected to a lift cord (18) for lifting and lowering of the slats (90) outside the blind (10). When the lift cord (18) is pulled, the pull cords (17*a* and 17*b*) are taken up or released synchronously to lift or lower the foot rail (12) so that the slats (90) are displaced upward and overlaid in sequence to close the blind (10), or the slats (90) are separated to open the blind (10) with slats (90) arranged in equal intervals.

Figure 5:
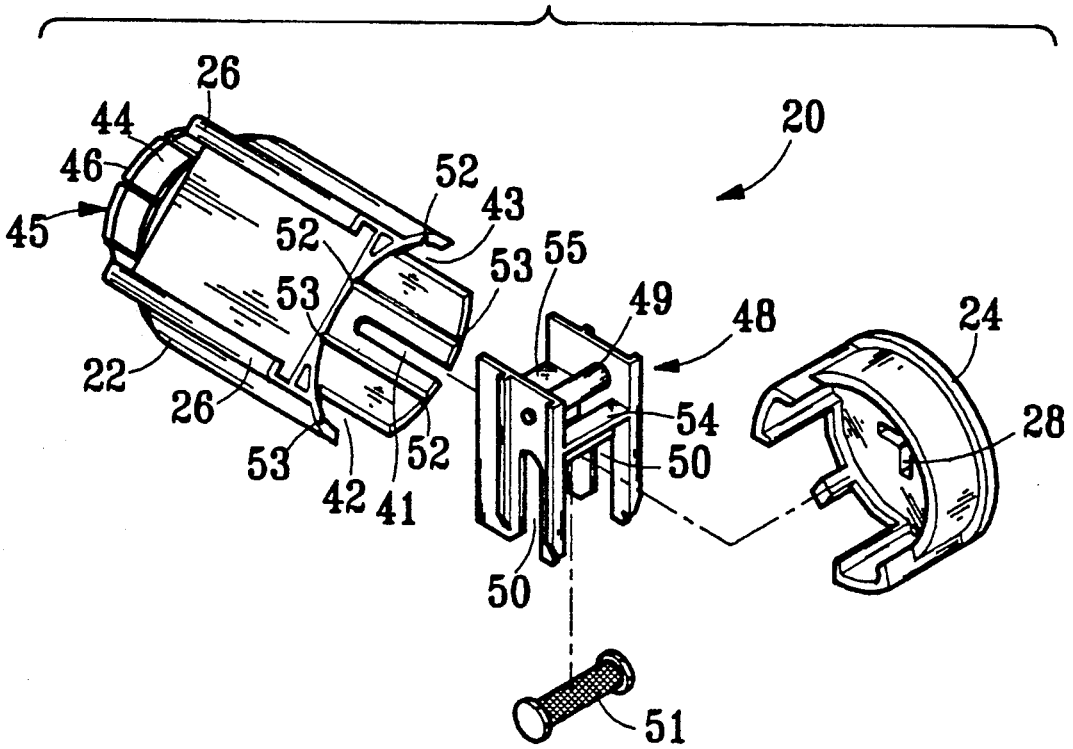
FIG. 5 is a perspective fragmented view of a cord-lock mechanism according to the present invention, in which the lift cord is omitted and all the components have been turned by 45 degree to illustrate shape of such components clearly.

Please refer to FIGS. 5, the cord-lock mechanism (20) to raise or lower the slats (90) comprises mainly a hollow drum (22) secured to a window frame (93) and an end cover (24) to cover the drum (22). The shape and structure of the drum (22) and the end cover (24) are exactly identical to the drums (21) and the end cover (23) for the tilter mechanism (19). The cord-lock mechanism (20) further includes a pulley block (48) fixed within the drum (22), a pulley (49) attached to the pulley block (48), a brake wheel (51) with teeth-like pattern engraved on its surface and displaced linearly upward and downward within a guide channel (50) at the pulley block (48), and a pair of L-like fixing elements (54 and 55) at two sides above the guide channel (50), each has a round corner at its turning point to prevent from wearing of the lift cord (18) as well as the pull cords (17*a* and 17*b*).

The drum (22) can be secured to either end, and hence it is designed with a cord outlet (41) in the middle of its bottom side, and two symmetric cord outlets (42 and 43), one at the left side and the other at the, right side. As shown in FIG. 1, both ends of the pull cords (17*a* and 17*b*) are extended out of the drum (22) through either the cord outlet (42) or another cord outlet (43) so that an end of the lift cord (18) can be pulled indoors and consequently raise or lower the slats (90).

The drum (22) has a connecting section (45) composed of a plurality of elastic connecting elements (44) arranged annularly in equal distance near an end of the tubular headrail (11). Each elastic connecting element (44) has a wedged end (46) extending outward. When the connecting section (45) of the drum (22) is fixed in the tubular headrail (11), the wedged ends (46) of the respective elastic connecting elements (44) are retained in a retaining groove (47) in the tubular headrail (11) so that the drum (22) is rotatably connected to the tubular headrail (1;) without risk of disengagement.

Figure 6:
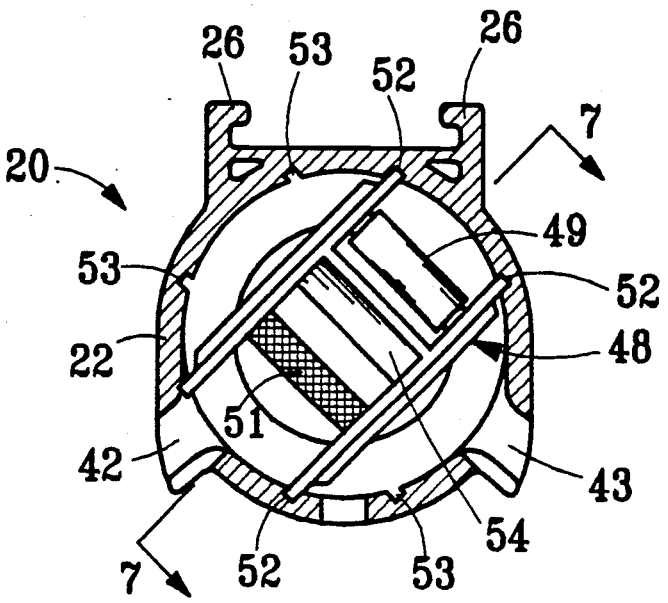
FIG. 6 is a longitudinal view of the cord-lock mechanism according to the present invention.

As shown in FIG. 6, there are two symmetric slide ways (52 and 53) on the inner wall of the drum (22), one at the left side and the other at the right side for the pulley block (48) to select either of them and to decline inward for about 45 degree so as to engage with the slide way (52 or 53) selected, and to align the pulley block with the cord outlet (42 or 43).

Figure 7:
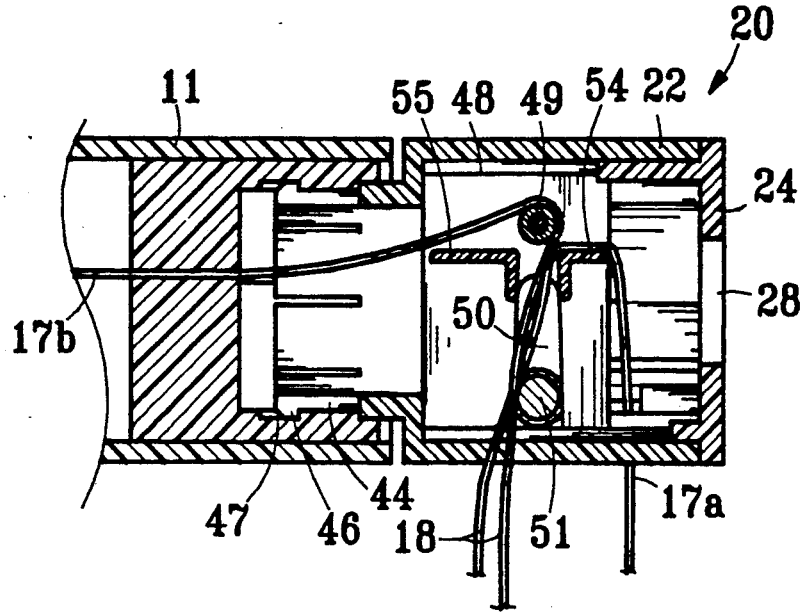
FIG. 7 is a sectional view taken along line 7—7 in FIG. 6.
Figure 8:
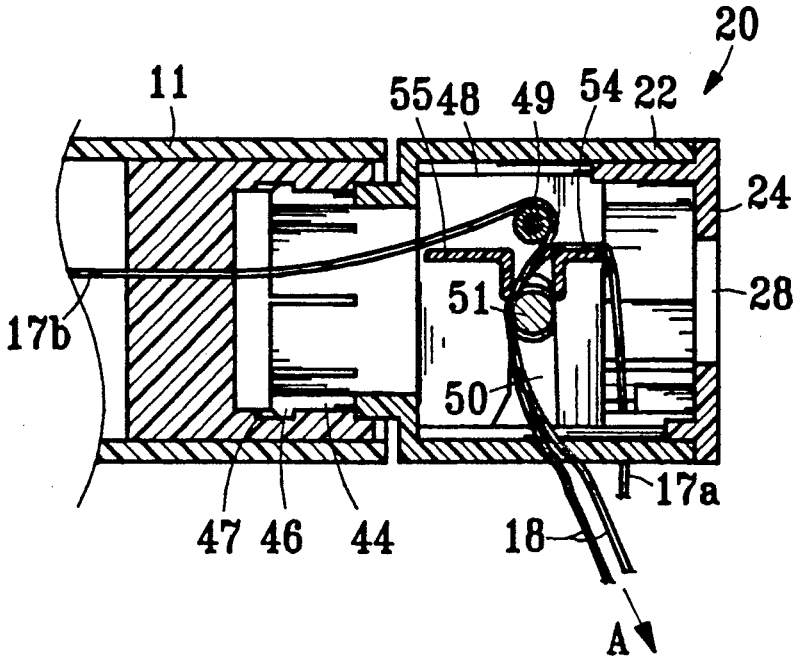
FIG. 8 is a similar to FIG. 7, except the brake wheel in FIG. 7 is at the release position, but the brake wheel in FIG. 8 is at the braking position.

Please refer to FIGS. 7 and 8, the ends of the lift cord (18) is, after passing through the brake wheel (51) and the pulley (49) or the L-like fixing elements (54), the pull cords (17*a* and 17*b*) at such ends are extended respectively toward to the drums (21 and 22) at two opposite ends of the tubular headrail (11), and then passing through the middle cord outlet of each drum (21 or 22), extended downward and tied to the respective ends of the tubular foot rail (12).

As shown in FIG. 7, when the lift cord (18) is suspended naturally, the brake wheel (51), with its own weight, is displaced downward to a release position at the bottom of the guide channel (50) to permit downward pulling of the lift cord (18) so that the pull cords (17*a* and 17*b*) are displaced synchronously to raise the foot rail (12) and consequently bring the slats (90) together so that the slats (90) are at nearly closing condition. When downward pulling of the lift cord (18) is stopped, the pull cords (17*a* and 17*b*) and the tubular foot rail (12) are displaced downward by the weight of the slats (90) and the foot rail (12) so that the slats are fully opened at equal distance.

As shown in FIG. 8, to maintain the Venetian blind at fully closing or partly opening condition, the lift cord (18) is pulled outward in the direction shown by the arrow A after a downward pulling force is applied to raise the slats (9) in order to force the brake wheel (51) to subject to an upward component force and displace to a braking position on the top of the guide channel (50). Above the braking position there are two symmetric L-like fixing elements (54 and 55) to act in association with the brake wheel (51) to retain the lift cord (18) to withstand the gravity of the slats (90) and the tubular foot rail (12), and then prevent the slats (90) from further displacement to fully opening condition, but maintain them at fully closing or partly opening condition. Because of the teeth-like pattern on the brake wheel (51), and since the lift cord (18) is formed by twisting of a plurality of wires to provide a rough surface, there is a considerable friction between the brake wheel (51) and the lift cord (18) to maintain at the braking position when the brake wheel (51) is engaged tightly with the lift cord (18) after release of the outward pulling force. To release the braking condition, an inward pulling force is applied to separate the brake wheel (51) and the lift cord (18) to displace the brake wheel (51) downward with its own weight to the release position.

In comparison with the conventional lifter, the cord-lock mechanism permits the headrail to rotate freely, and does not requires such sophisticated components such as worm drive, long transmission shaft, gear trains, etc. Number of components required is decreased effectively, structure is simplified, production cost is lowered, and mass production with automatic assembly process is feasible. Moreover, it can be installed at either side of the headrail to satisfy the user's habit or environmental requirements.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A cord-lock mechanism for a Venetian blind comprising a rotary tubular headrail, a rotary tubular foot rail, at least two ladder sets fixed between the headrail and the foot rail each comprising an inner ladder tape and an outer ladder tape running in parallel with each other as well as a plurality of equidistant and parallel horizontal connecting tapes each supporting a slat between the inner and outer ladder tapes, said slats being above the respective horizontal connecting tapes, and a lifter comprising:

a fixed hollow drum secured to the headrail and permitting free rotation of the headrail, the drum including an inner surface provided with a plurality of slide ways;

an end cover firmly secured to the hollow drum to define in the hollow drum a middle cord outlet and two cord outlets symmetrically located on two ends of the hollow drum;

a pully block fixed in the hollow drum, having a guide channel and two symmetric L-like fixing elements located at two opposite sides above the guide channel;

a pulley at the pulley block at a position just above the guide channel; and a brake wheel with teeth-like pattern engraved on its surface, reciprocally movable between a braking position and a release position in the guide channel;

a lift cord made of soft material, wound around the brake wheel and the pulley, having its both ends extended to the respective ends of the headrail, passed through the middle cord outlets, turned downwards and tied to the respective ends of the foot rail so as to drive the brake wheel to displace between a braking position and a release position in the slide ways by pulling the lift cord slantwise; to retain the lift cord by action of the brake wheel at the braking position and the two L-like fixing elements; and to permit free pulling of the lift cord while the brake wheel is at the release position.

2. A cord-lock mechanism as claimed in claim 1 wherein the hollow drum has two symmetric slide ways on its inner wall, one at the left side and the other at the right side for the pulley block to select either of them and to decline inward for about 45 degree so as to engage with the slide way selected, and to align the pulley block with the cord outlet.

3. A cord-lock mechanism as claimed in claim 1 wherein the drum has a connecting section composed of a plurality of elastic connecting elements arranged annularly, the headrail has a connecting slot corresponding to such connecting section so that the drum can be rotatably engaged with the headrail.

4. A cord-lock mechanism as claimed in claim 1 wherein the drum includes means for securing the drum to a window frame.

* * * * *